United States Patent [19]

Larcen

[11] 4,113,418

[45] Sep. 12, 1978

[54] ROTARY BURNER CONTROL

[76] Inventor: Donald W. Larcen, 2417 Grenoble Rd., Richmond, Va. 23229

[21] Appl. No.: 804,689

[22] Filed: Jun. 8, 1977

Related U.S. Application Data

[63] Continuation-in-part of Ser. No. 664,214, Mar. 5, 1976, Pat. No. 4,035,133.

[51] Int. Cl.[2] ..... F23M 1/02

[52] U.S. Cl. ..... 431/12; 239/262; 431/90; 431/168

[58] Field of Search ..... 431/4, 12, 168, 90, 431/190, 8, 9; 239/251, 262

[56] References Cited

U.S. PATENT DOCUMENTS

| | | | |
|---|---|---|---|
| 2,536,379 | 1/1951 | Linden | 431/4 |
| 3,391,866 | 7/1968 | Rohrer | 431/90 X |
| 3,771,940 | 11/1973 | Stranahan | 431/90 X |
| 3,843,310 | 10/1974 | Massi | 431/90 |
| 3,844,705 | 10/1974 | Miyahara | 431/190 X |

*Primary Examiner*—Edward G. Favors

*Attorney, Agent, or Firm*—Griffin, Branigan and Butler

[57] ABSTRACT

An improved embodiment of the rotary fuel-steam burner system described in copending application Ser. No. 664,214 filed Mar. 5, 1976, now U.S. Pat. No. 4,035,133.

A fuel flow set point signal is delivered to a diaphragm motor valve to set a desired fuel flow-area therein; and, a differential pressure regulator maintains a correspondingly desired pressure drop thereacross.

In a sonic flow embodiment regulator steam flow is controlled by a differential pressure regulator having its low pressure side connected to a ratio control device and its high pressure side connected to a downstream point in the steam line.

14 Claims, 2 Drawing Figures

ROTARY BURNER CONTROL

BACKGROUND OF THE INVENTION

This is a continuation-in-part of my U.S. application Ser. No. 664,214 which was filed on Mar. 5, 1976 now U.S. Pat. No. 4,035,133. That application describes a control system for rotary burners in which oil flow and steam flow are kept in desired proportion by a ratio controller which controls steam flow as a predetermined function of the existing oil flow. That application is incorporated herein by reference, and describes embodiments wherein actual fuel flow and steam flow are measured at given points in the steam and fuel line, and flow is adjusted by control valves in the respective lines so that the actual fuel and steam flows are as desired.

One previous implementation of the basic system includes a regulator of the type described in U.S. Pat. No. 2,800,919 to Kates and in Bulletin 701(6-70-5M) of the W. A. Kates Company of Deerfield, Ill. Therein, an adjustable-orifice flow-rate controller was positioned in the fuel line where flow was to be measured. The size of the orifice was then varied to set the desired amount of fuel flow; and, the pressure across the orifice was maintained constant by varying a related fuel-flow control valve in the fuel line. In this manner, variations in fuel flow set-point were effected by merely changing the size of the variable orifice.

The variable-orifice embodiment offered a potential of better control over more conventional constant-orifice embodiments as the flow-control was more positive and speed of response was also improved. Consequently, the variable-orifice embodiments provided control improvements. The variable-orifice embodiments, however, were still relatively expensive. Hence, the instant invention is intended to provide a less expensive control system that nevertheless has fast, accurate, and positive response. Moreover, its use of a variable flow-area results in directly proportional flow that is precisely controllable at low pressure drops—as opposed to fixed orifice devices where flow is proportional to the square root of pressure drop and, therefore, very difficult to control at low pressure drops.

SUMMARY

In accordance with this invention, further cost reduction is obtained while still keeping the more direct control features of prior embodiments. In this respect, the valve-seat flow area of a diaphragm motor valve functions as a variable orifice which is adjusted in accordance with the desired oil flow set-point. A differrential pressure regulator is then used to maintain the desired differential pressure across the diaphragm motor valve to thus maintain a constant oil flow for a constant heat release. At the same time, the oil flow set-point signal is delivered to a ratio controller which operates to control steam flow in accordance with my pending application Ser. No. 664,214, now U.S. Pat. No. 4,035,133.

In a further improvement, I have modified the steam control portions of my system for use in cases where steam pressure-drops are greater than sonic. In the rotary burners where primary use of my invention is contemplated, for example, pressure drops across steam ejectors are often greater than sonic. Hence, since steam is compressable, steam flow is directly proportional to absolute pressure—not the product of absolute pressure and pressure drop as when subsonic flow prevails. In this respect, in the further improved embodiment, the relatively elaborate steam control portions are replaced by a simple differential pressure regulator connected between the steam flow line and the ratio control device.

BRIEF DESCRIPTION OF THE DRAWINGS

The foregoing and other objects, features, and advantages of the invention will be apparent from the following more particular description of preferred embodiments of the invention as illustrated in the accompanying drawings, wherein the same reference characters refer to the same parts throughout the various views. The drawings are not necessarily drawn to scale. Instead, they are merely presented so as to illustrate principles of the invention in a clear manner.

In FIG. 1, fuel oil flows in line 12 to a rotary burner (not shown) as described in my pending application. Similarly, steam in line 14 is delivered to the rotary burner wherein the flows of fuel, steam, and air are adjusted to provide a desired mixture for burning in the burner's burn zone.

Figure 1:
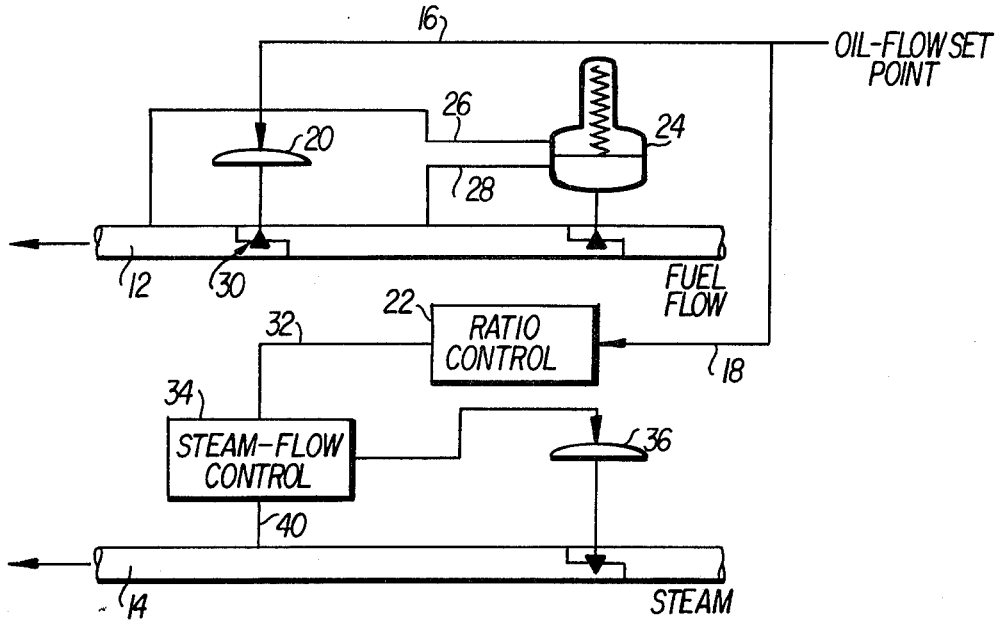
FIG. 1 is an illustration, partially structural and partially schematic, of a preferred embodiment of the invention; and, FIG. 2 is also partially structural and partially schematic and represents a second embodiment of the invention containing modifications to the steam control portions of FIG. 1.

In the FIG. 1 embodiment, a desired oil-flow set-point signal is delivered on lines 16 and 18 to a simple diaphragm motor valve 20 and a ratio controller 22, respectively. A differential pressure regulator 24 has one side thereof connected by line 26 to a point in line 12 downstream of the diaphragm motor valve 20; and, the other side thereof connected by line 28 to point upstream of the diaphragm motor valve 20. In this respect, flow signals are delivered on line 16 to the diaphragm motor valve 20 in accordance with the desired heat requirements of the burner; and, its valve-seat flow-area 30 is adjusted accordingly. The differential pressure regulator 24 then maintains a constant differential pressure across the flow-area 30 so that oil flow in relation to heat release is adjusted by setting the position of the diaphragm motor control valve 20; and, the differential pressure regulator 24 maintains the differential constant across the diaphragm motor valve's flow-area 30, thus maintaining a constant oil flow for constant heat release.

At the same time, the set-point signal is delivered on line 18 to the ratio control device 22 which delivers a proportional signal on line 32 to a steam flow controller 34 in accordance with a previously determined flow ratio as described in my co-pending application. The flow controller 34 then adjusts a steam flow control valve 36 which thusly permits delivery of the proper steam flow.

Additionally, as in my parent application, the steam flow can be measured as represented by line 40 from the steam flow controller 34. The steam flow control valve 36 is then adjusted accordingly to account for undesired variations in steam flow from that which was previously determined by the ratio controller 22 which delivered a corresponding signal to the steam flow control mechanism 34 along line 32.

When it is desired to change the burner's heat release, the flow-area 30 of the diaphragm motor valve 20 is suitably adjusted; and, the output signal from the ratio control device causes the steam flow to be adjusted accordingly. In this respect, the reader is referred to my parent case for a discussion of the prior adjustment of the steam flow and ratio control device 22 so that the desired steam-fuel flow ratio is maintained without regard to the pressure differential between the steam and fuel lines; but, wherein the desired steam-fuel pressure ratios are nevertheless maintained.

Figure 2:
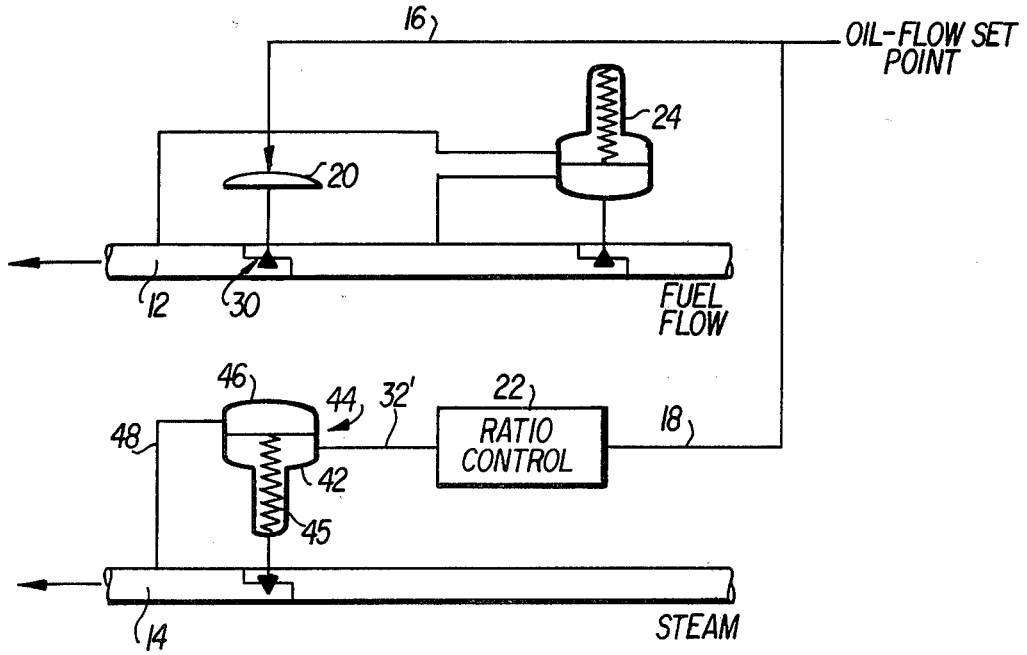

In FIG. 2, the steam flow control aspects of the FIG. 1 structure have been modified. In this respect, the modifications about to be described result from the pressure drop in the ejector portion of the steam line being greater than sonic. Hence, steam flow is directly proportional to the steam line's absolute pressure—not the product of absolute pressure and pressure drop as when sonic flow is used.

In the above regard, the ratio control signal from ratio controller 22 is delivered on line 32' to the low pressure side 42 of a differential pressure regulator 44 which has the high pressure side 46 thereof connected by line 48 to the steam flow line 14. In this manner, the steam flow in line 14 is automatically and inexpensively monitored and adjusted in accordance with the desired ratio as determined by the ratio control 22 and its proportional signal on line 32' to the pressure regulator 44 biased by the spring 45 against the steam pressure in line 48. Moreover, the directly operated differential pressure regulator provides both better control of the system and increased speed of response. That is, it is no longer necessary to separately monitor steam flow (as by line 40 in FIG. 1) because the relatively simple differential pressure regulator 44 serves in place of the line 40 apparatus; the steam flow control 34; and the steam-flow control valve 36.

While the invention has been particularly shown and described with reference to preferred embodiments thereof, it will be understood by those skilled in the art that various changes in form and detail may be made therein without departing from the spirit and scope of the invention. For example, while specific types of differential pressure regulators are illustrated, various other types can also be employed.

The embodiments of the invention in which an exclusive property or privilege is claimed are defined as follows:

1. A method of operating a rotary burner of the type in which quantities of fuel and steam are controlled, respectively by a diaphragm motor valve and a steam-flow control mechanism to deliver fuel and steam into an air stream through a rotating member, said method comprising the steps of:

determining the amount of fuel flow that is required through said burner to produce various values of heat release;

adjusting a ratio-control device to provide an output signal level to said steam-flow control mechanism corresponding to a desired steam flow for each given fuel flow in a series of fuel flows;

setting said diaphragm motor valve to adjust flow area therein for providing a flow of fuel corresponding to a desired heat release value;

monitoring the differential pressure across said flow area and adjusting said fuel flow to maintain a differential pressure corresponding to the desired fuel flow through said flow area; and, regulating said steam flow in accordance with the previously adjusted output signal level from said ratio-control device corresponding to said desired heat release value.

2. The method of claim 1 including the step of modifying the setting of said diaphragm motor valve to provide a modified flow of fuel corresponding to a different heat release value; and, modifying said steam flow in accordance with the previously adjusted output signal level from said ratio-control device corresponding to said different heat release value.

3. The method of claim 1 including the step of monitoring said steam flow and changing the setting of said steam-flow control mechanism in accordance with variations in said steam flow from the previously determined steam flow corresponding to said desired heat release value.

4. The method of claim 1 wherein said steam-flow control mechanism comprises a differential pressure regulator, said method including the steps of:

monitoring said steam flow by means of said differential pressure regulator wherein a high pressure side thereof measures pressure downstream of said differential pressure regulator and said output signal from said ratio-control device is delivered to a low pressure side thereof.

5. In a rotary burner control system, a flow control system for said rotary burner comprising:

delivery means for delivering fuel to said burner;

a diaphragm motor valve operative to provide a variable flow area in said fuel delivery means;

a differential pressure regulator for maintaining a predetermined pressure differential across said diaphragm motor valve to deliver a predetermined quantity of fuel to said burner;

means for delivering steam to said burner;

an adjustable steam-flow valve for regulating the flow of steam to said burner;

steam-flow control means for adjusting the position of said steam-flow valve; and, selectively settable ratio control means for providing an output signal to said steam-flow control means, there being a predetermined ratio of steam flow to fuel flow for any desired fuel flow within a given range of fuel flows, so that adjustment of said diaphragm motor valve to deliver a desired amount of fuel to said burner results in a corresponding steam flow to said burner in accordance with the predetermined ratio for the desired fuel flow.

6. The control mechanism of claim 5 including means for modifying the setting of said diaphragm motor valve to correspond to a newly desired fuel flow; and, means for adjusting the output signal of said ratio means accordingly so that said steam flow to said burner is modified to correspond to the predetermined ratio for the newly-desired fuel flow.

7. The control mechanism of claim 5 wherein said steam-flow control means includes means for sensing the actual flow of steam to said burner and is adapted to change the adjustment of said steam-flow value by an amount corresponding to that by which said actual steam flow varies from that corresponding to the predetermined ratio for the desired fuel flow.

8. The control mechanism of claim 7 including means for modifying the setting of said fuel-flow control means and thereby said diaphragm motor valve to correspond to a newly desired fuel flow; and, means for adjusting the output signal of said ratio control means accordingly so that said steam flow to said burner is modified to correspond to the predetermined ratios for the newly-desired fuel flow.

9. The control mechanism of claim 5 including means to selectively direct one type of fuel or another to said diaphragm-motor valve; and wherein said ratio-control device is adapted to be adjusted accordingly.

10. A rotary burner mechanism including:

a rotating member having perforated arms for directing a mixture of steam and fuel therefrom to cause said rotating member to rotate;

a fan member rotatable in response to rotation of said rotating member to cause air to mix with said steam and fuel mixture and project said steam and fuel into a flame zone;

fuel delivering means for delivering fuel to said rotating member;

steam delivering means for delivering steam to said rotating member;

a venturi in said steam delivering means;

connecting means at said venturi for connecting said venturi to said fuel delivering means; said venturi thereby being operative to cause said fuel to mix with said steam;

an adjustable diaphragm motor valve in said fuel delivery means for providing a variable flow area in said fuel delivering means;

a differential pressure regulator for maintaining a predetermined pressure differential across said diaphragm motor valve to deliver a predetermined quantity of fuel to said burner;

an adjustable steam-flow valve for regulating the flow of steam in said steam delivering means;

steam-flow control means for adjusting the position of said steam-flow valve; and, selectively settable ratio control means for providing an output signal to said steam-flow control means, there being a predetermined ratio of steam flow to fuel flow for any desired fuel flow within a given range of fuel flows, so that adjustment of said diaphragm motor valve to deliver a desired amount of fuel to said burner results in a corresponding steam flow to said burner in accordance with the predetermined ratio for the desired fuel flow, whereby variations in pressure at said venturi during operation at a given setting of said fuel-flow valve do not detrimentally affect the desired steam and fuel mixture that is projected into said flame zone.

11. In a rotary burner control system, a flow control system for said rotary burner comprising:

delivery means for delivering fuel to said burner;

a diaphragm motor valve operative to provide a variable flow area in said fuel delivery means;

a first differential pressure regulator for maintaining a predetermined pressure differential across said diaphragm motor valve to deliver a predetermined quantity of fuel to said burner;

means for delivering steam to said burner;

a second differential pressure regulator for regulating the flow of steam to said burner, said second pressure regulator having a low pressure side and a high pressure side;

selectively settable ratio control means for providing an output signal to said low pressure side of said second differential pressure regulator, the high pressure side thereof being connected downstream of said second differential pressure regulator, there being a predetermined ratio of steam flow to fuel flow for any desired fuel flow within a given range of fuel flows, so that adjustment of said diaphragm motor valve to deliver a desired amount of fuel to said burner results in a corresponding steam flow to said burner in accordance with the predetermined ratio for the desired fuel flow.

12. The control mechanism of claim 11 including means for modifying the setting of said diaphragm motor valve to correspond to a newly desired fuel flow; and, means for adjusting the output signal of said ratio means accordingly so that said steam flow to said burner is modified to correspond to the predetermined ratio for the newly-desired fuel flow.

13. The control mechanism of claim 11 including means to selectively direct one type of fuel or another to said diaphragm-motor valve; and wherein said ratio-control device is adapted to be adjusted accordingly.

14. A rotary burner mechanism including:

a rotating member having perforated arms for directing a mixture of steam and fuel therefrom to cause said rotating member to rotate;

a fan member rotatable in response to rotation of said rotating member to cause air to mix with said steam and fuel mixture and project said steam and fuel into a flame zone;

fuel delivering means for delivering fuel to said rotating member;

steam delivering means for delivering steam to said rotating member;

a venturi in said steam delivering means;

connecting means at said venturi for connecting said venturi to said fuel delivering means; said venturi thereby being operative to cause said fuel to mix with said steam;

an adjustable diaphragm motor valve in said fuel delivery means for providing a variable flow area in said fuel delivering means;

a first differential pressure regulator for maintaining a predetermined pressure differential across said diaphragm motor valve to deliver a predetermined quantity of fuel to said burner;

a second differential pressure regulator for regulating the flow of steam to said burner, said second pressure regulator having a low pressure side and a high pressure side;

selectively settable ratio control means for providing an output signal to said low pressure side of said second differential pressure regulator, the high pressure side thereof being connected downstream of said second differential pressure regulator, there being a predetermined ratio of steam flow to fuel flow for any desired fuel flow within a given range of fuel flows, so that adjustment of said diaphragm motor valve to deliver a desired amount of fuel to said burner results in a corresponding steam flow to said burner in accordance with the predetermined ratio for the desired fuel flow, whereby variations in pressure at said venturi during operation at a given setting of said fuel-flow valve do not detrimentally affect the desired steam and fuel mixture that is projected into said flame zone.

* * * * *